US010335701B2

(12) United States Patent
Cho

(10) Patent No.: US 10,335,701 B2
(45) Date of Patent: Jul. 2, 2019

(54) MODEL RAILCAR FOR CLEANING MODEL TRAIN TRACK

(71) Applicants: Korea Brass Co., Ltd., Seoul (KR); Sung-Won Cho, Seoul (KR)

(72) Inventor: Sung-Won Cho, Seoul (KR)

(73) Assignees: KOREA BASS CO., LTD., Seoul (KR); Sung-Won Cho, Seoul (KR)

( * ) Notice: Subject to any disclaimer, the term of this patent is extended or adjusted under 35 U.S.C. 154(b) by 220 days.

(21) Appl. No.: 15/308,714

(22) PCT Filed: Apr. 7, 2014

(86) PCT No.: PCT/KR2014/002955
§ 371 (c)(1),
(2) Date: Nov. 3, 2016

(87) PCT Pub. No.: WO2015/156424
PCT Pub. Date: Oct. 15, 2015

(65) Prior Publication Data

US 2017/0203223 A1 Jul. 20, 2017

(51) Int. Cl.

| | |
|---|---|
| ***A63H 19/15*** | (2006.01) |
| ***A63H 19/02*** | (2006.01) |
| ***B08B 1/00*** | (2006.01) |
| ***B08B 5/04*** | (2006.01) |

(52) U.S. Cl.
CPC ..... *A63H 19/15* (2013.01); *A63H 19/02* (2013.01); *B08B 1/006* (2013.01); *B08B 1/008* (2013.01); *B08B 5/04* (2013.01)

(58) Field of Classification Search
CPC ..... A63H 19/00; A63H 19/02; A63H 19/15; A63H 19/16; A63H 19/24
See application file for complete search history.

(56) References Cited

U.S. PATENT DOCUMENTS 6,536,355 B1 * 3/2003 Amemiya ..... A63H 19/15 104/279

FOREIGN PATENT DOCUMENTS

KR 20110023232 * 3/2011 ..... A63H 19/02

* cited by examiner

*Primary Examiner* — Robert J McCarry, Jr.
(74) *Attorney, Agent, or Firm* — Weiss & Moy, P.C.; Jeffrey D. Moy

(57) ABSTRACT

The present invention provides a model railcar for cleaning, which can remove an oxide film and an oil film from the surface of rails and can simultaneously remove fine metal components, such as metal powder. The model railcar for cleaning comprises: a fan arranged towards a train track; a dust collecting chamber for containing alien substances drawn in by the fan; a cleaning block having a cleaning pad attached to a surface of the model train track, which faces the rails, a member capable of polishing or washing the rails being positioned on the cleaning pad; and a permanent magnet positioned to face the model train track.

9 Claims, 5 Drawing Sheets

MODEL RAILCAR FOR CLEANING MODEL TRAIN TRACK

TECHNICAL FIELD

The present invention relates to a model railcar capable of cleaning various types of foreign substances existing on a model train track.

BACKGROUND ART

Reducing a train transport system at a constant rate to make a model is called railway modelling, and a model train including a model locomotive and model rolling stocks, train tracks, signal devices, landscapes, model figures, and the like are used in the railway modelling. In a model train, an "O" gauge having a reduction rate of 1:48 and an "HO" gauge having a reduction rate of 1:87 are most widely used.

Generally, a model train is driven on model train tracks by rotating train wheels using a motor. Electricity for driving the motor is supplied through rails of the model train tracks, which are made of a metal such as steel, brass, or nickel, and is transferred to the motor through the train wheels. Since the model train tracks are made of a metal in this manner, surfaces of the tracks may be oxidized and this oxidation results in a reduction of efficiency of electricity supply through the tracks. Further, the model train tracks may be coated with oil components such as oil and grease due to carelessness, someone's touch, or the like, and these also reduce the efficiency of electricity supply. In addition, dust, pet hair, and the like may be wound on small parts such as a train engine and the like and may result in an operational failure of the model train. Fine metal components such as metal powder may be attached to magnet components of speakers and may result in problems. Thus, various types of foreign substances which interfere with efficient and normal operation of the model train are present on the track of the model train, and thus it is necessary to clean these foreign substances.

In U.S. Pat. No. 6,758,145, a model railcar for cleaning is disclosed, and model train tracks are cleaned by a single polishing pad pressed by a force of a spring. In a model railcar for cleaning disclosed in United States Unexamined Patent Application Publication No. 2006/0196386A1, model train tracks are also pressed by a force of a spring and are cleaned by two footing parts positioned at a front and back of the model railcar in a longitudinal direction of the railcar. In these model railcars for cleaning, an oxide film or dust on surfaces of the model train tracks may be cleaned, but there is a problem in that other foreign substances may not be cleaned.

In U.S. Pat. No. 8,371,229, a model railcar for cleaning in which model train tracks are cleaned by a single polishing pad, which is rotated by a motor while being pressed by a force of a spring, is disclosed. This model railcar for cleaning may also clean only an oxide film or dust on surfaces of the model train tracks, and since the polishing pad is rotated by the motor, there is a concern about excessive wear on rails.

In a model railcar for cleaning disclosed in Korean Unexamined Patent Application Publication No. 2011-0023232, model train tracks are cleaned by arranging a motor driving suction fan, a permanent magnet, rag-coated wheels, and a ski-form member having sand paper attached thereunder in series in a longitudinal direction of the model railcar. This model railcar for cleaning may remove a larger variety of foreign substances, but there is a problem in that a configuration thereof is complex and oil components such as oil and grease may not be removed.

Thus, there is a need for a model railcar for cleaning in which an oxide film may be removed from surfaces of rails while preventing the rails from being excessively worn, various foreign substances including oil components such as oil and grease may be removed, and a configuration thereof is simple.

DISCLOSURE

Technical Problem

The present invention is directed to providing a model railcar for cleaning a model train track which is driven by a force of a motor embedded in the model railcar to independently clean the model train track, wherein electricity for driving the motor is supplied through the model train track and train wheels in the same manner as a general model train.

Technical Solution

One aspect of the present invention provides a model railcar for cleaning a model train track including a fan arranged toward a model train track, a dust collecting chamber configured to accommodate foreign substances suctioned by the fan, and a cleaning block having a cleaning pad attached to a surface of the model train track, which faces rails, wherein a member capable of polishing or washing the rails is positioned on the cleaning pad.

The fan may be driven by another motor, may suction dust, pet hair, or the like on the model train track, and may transmit the suctioned dust, pet hair, or the like to the dust collecting chamber through a path connected to the dust collecting chamber.

The cleaning block may include a solution container positioned on an upper portion thereof and a cleaning pad attachment part positioned on a lower portion thereof, and a through hole may be formed between the solution container and the cleaning pad attachment part so that a solution in the solution container is transferred to the cleaning pad. The cleaning block may be attached to and detached from a lower portion of the model railcar using a magnetic coupling force between a magnet and a ferromagnetic material. Since the cleaning block is detachable, the cleaning block may be separated as necessary and may easily clean the solution container.

The cleaning pad may be detachable to the cleaning block and formed of an elastic material. A lower end surface of the cleaning pad which is attached to the cleaning block may be positioned lower than upper surfaces of the rails of the model train track, may be elastically pressed, and may come into contact with the rails. The member capable of polishing or washing the rails, such as sand paper or a cleaning towel, may be positioned on a surface of the cleaning pad, which faces the rails of the model train track. Since the cleaning pad is also detachable, the cleaning pad may very conveniently remove an oxide film from surfaces of the rails using a pad having the member capable of polishing or washing the rails, such as sand paper, and an oil film from the surfaces of the rails using a pad having the member capable of polishing or washing the rails, such as a cleaning towel. The cleaning pad may be formed to have a plate block form having a rectangular cross section, and the member capable of polishing or washing the rails may surround the plate block like a bag. Further, the body of the model railcar for cleaning may be formed of zinc in order to increase an elastic pressing force of the cleaning pad with respect to the rails.

The model railcar for cleaning may further include a permanent magnet positioned to face the model train track, and fine metal components such as metal powder on the model train track may also be preferably removed.

ADVANTAGEOUS EFFECTS

MODES OF THE INVENTION

Hereinafter, embodiments of the present invention will be described with reference to the accompanying drawings, but are not limited to the present invention and should be considered in a descriptive sense only.

Figure 1:
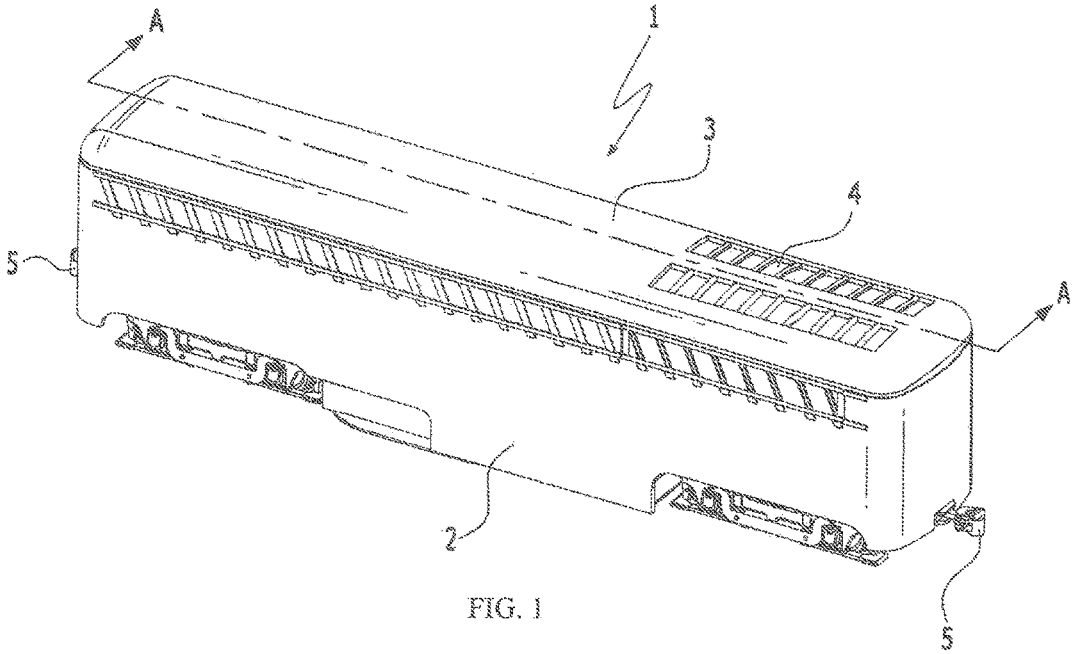
FIG. 1 is a perspective view of a model train for cleaning according to the present invention.
Figure 2:
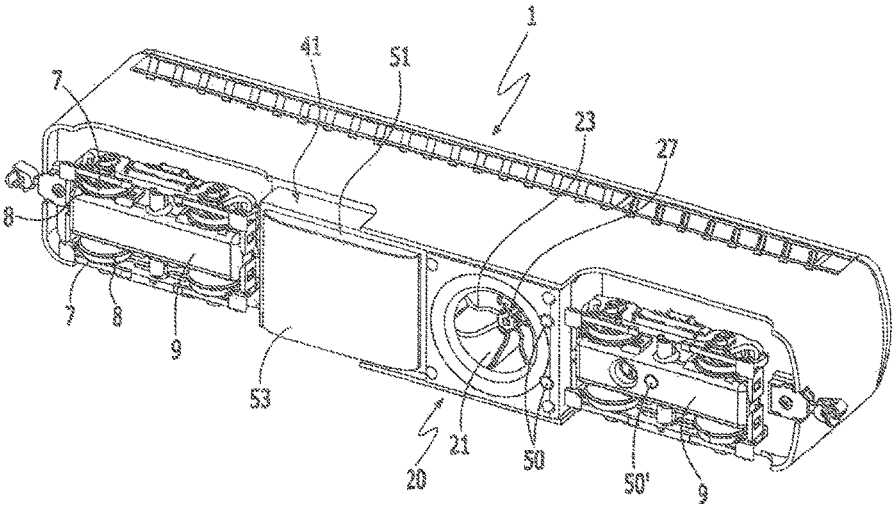
FIG. 2 is a bottom perspective view of the model train illustrated in FIG. 1.
Figure 4:
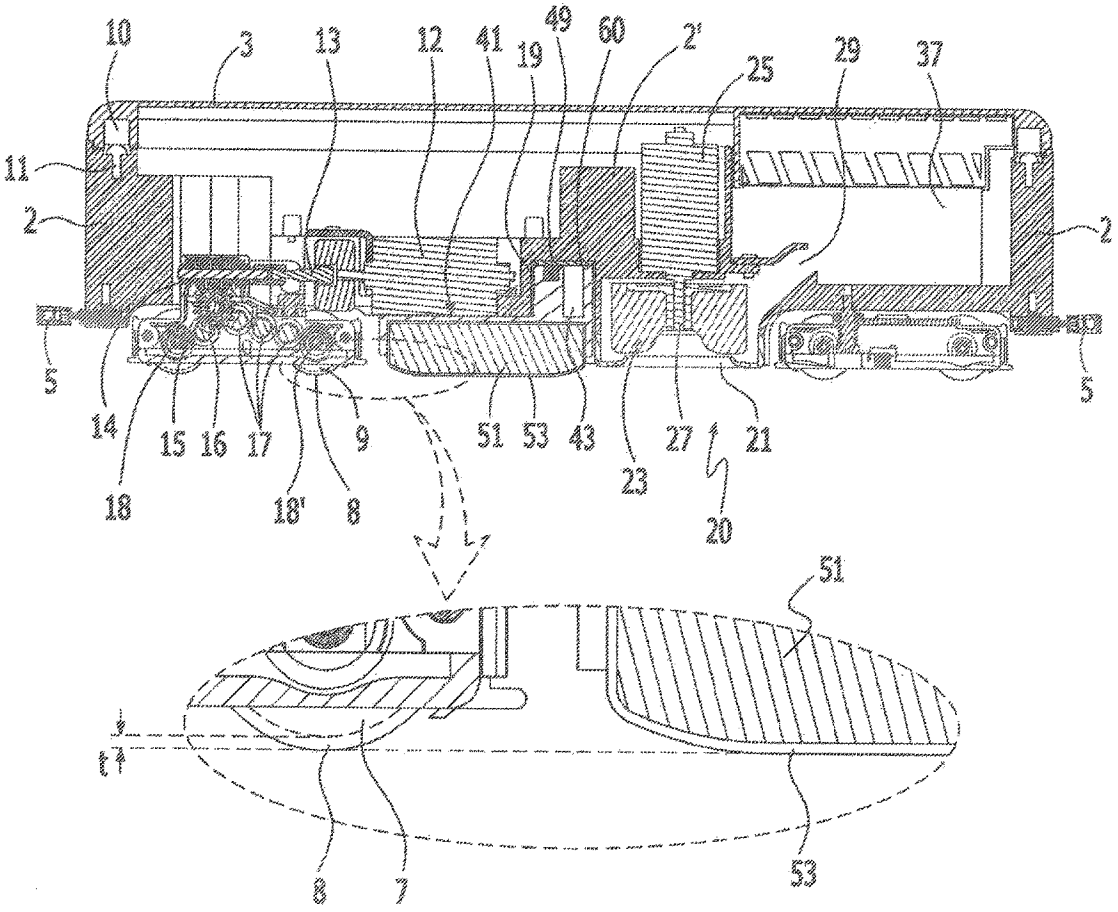
FIG. 4 is a cross-sectional view of the model train illustrated in FIG. 1 taken along line A-A.

Referring to FIGS. 1, 2, and 4, a model railcar for cleaning 1 which cleans a model train track according to the present invention is driven by a motor 12 embedded therein, and the motor 12 is driven by electricity supplied through the model train track and train wheels in the same manner as a general model train. The motor 12 rotates a first driving gear 14 through a shaft 13, a rotational velocity of the first driving gear 14 is reduced to an appropriate rotational velocity by a series of gear columns 15, 16, and 17 to be transferred to wheel shafts 18 and 18' of the model railcar, and train wheels 7 positioned at both sides of a wheel moving body 9 operate along the model train track. Thus, the model railcar for cleaning 1 is driven along the model train track at a low speed to thoroughly clean the model train track. Flanges 8 are respectively formed on the train wheels 7 along an inner periphery thereof to prevent derailing. The model railcar for cleaning 1 may be driven alone by embedding the motor 12 therein, and may be connected to other railcars by couplers 5 as necessary.

Figure 3:
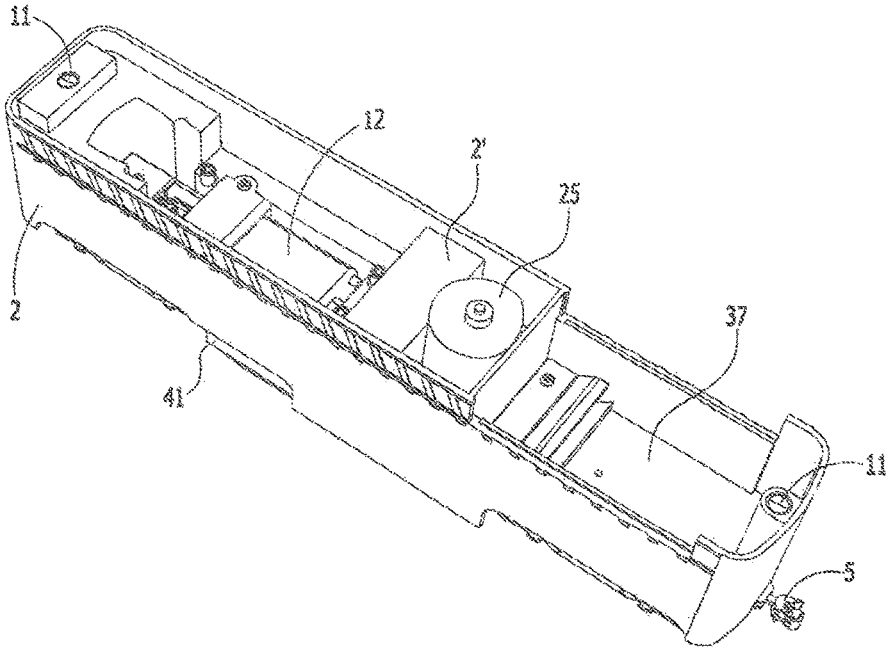
FIG. 3 is a perspective view of a model train in a state in which a cover is removed.

The model railcar for cleaning 1 includes a main body 2 in which most components constituting this model railcar are positioned, and a cover 3 having an exhaust port 4. Referring to FIGS. 3 and 4, ferromagnetic metal 11 such as iron or steel may be fixed in a vicinity of both ends of the main body 2, magnets 10 may be attached to portions corresponding to the cover 3, and thus the main body 2 and the cover 3 may be easily separated from or combined with each other. In the embodiment, the ferromagnetic metal 11 is illustrated as being positioned in the main body 2 and the magnets 10 are illustrated as being attached to the cover 3, but their positions may be replaced by each other. Parts embedded therein may be maintained or replaced by separating the cover 3 as necessary or integrated dust and the like may be removed from a dust collecting chamber 37, which collects dust and the like and is positioned at a side of the main body 2.

Referring to FIG. 2, the model railcar for cleaning 1 includes a fan structure 20 including a fan 23 positioned in a direction toward the model train track, and a cleaning block 41 to which a cleaning pad 51 is attached.

Since an inlet 21 is formed on a bottom surface of the fan structure 20, dust, pet hair, or the like on the model train track and in the vicinity thereof is suctioned into the fan structure 20 when the fan 23 is rotated. Referring to FIGS. 3 and 4, the fan 23 is rotated by another motor 25 through a motor shaft 27. The motor 25 is also driven by electricity supplied through the model train track and the train wheels in the same manner as the motor 12, and a method of supplying electricity to the motors 12 and 25 through the model train track and the train wheels is well known to those skilled in the art. Since a rotational velocity of the motor 25 is not reduced unlike that of the motor 12, the model railcar for cleaning 1 may be driven at a low speed under the same current, but the fan 23 may be rotated at a high speed. The fan structure 20 and the dust collecting chamber 37 are connected to each other through a path 29. When the fan 23 is rotated, an air current introduced through the inlet 21 is pushed out through blades of the fan 23 and a space between the blades, passes through the path 29, and flows into the dust collecting chamber 37. While a flow velocity of the air current passing through the narrow path 29 is rapidly reduced in the dust collecting chamber 37 which is a relatively wide space, accompanying dust or the like is collected on a bottom of the dust collecting chamber 37 and the air current is discharged to the outside through the exhaust port 4 formed in the cover 3.

Figure 5:
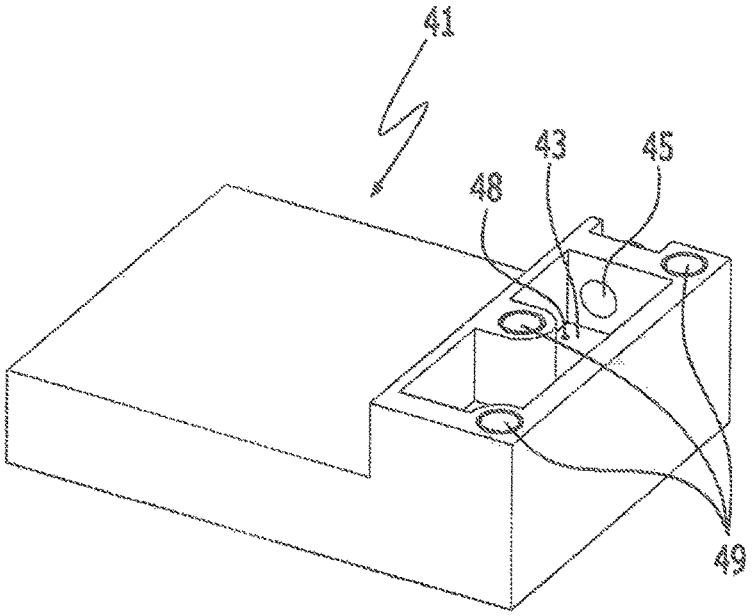
FIG. 5 is a perspective view of a cleaning block of a model train for cleaning.
Figure 6:
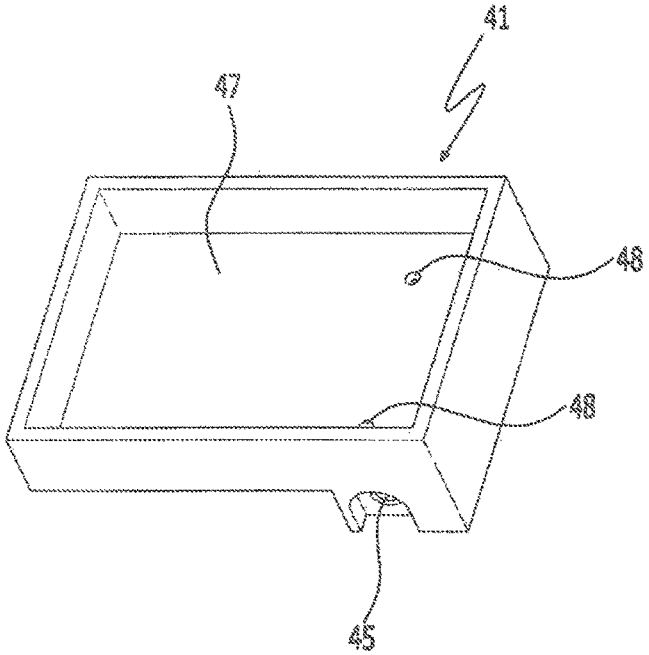
FIG. 6 is a bottom perspective view of the cleaning block illustrated in FIG. 5.

Referring to FIGS. 5 and 6, the cleaning block 41 includes a solution container 43, which may hold liquid and is formed on an upper portion thereof, and a cleaning pad attachment part 47, to which the cleaning pad 51 is attached and which is formed on a lower portion thereof. In the embodiment, the cleaning pad attachment part 47 is a rectangular groove. A hole 45 for injecting a solution is formed on a side surface of the solution container 43, and a through hole 48 connected to the cleaning pad attachment part 47 is formed on a bottom of the solution container 43. Since an inlet 6 (see FIG. 7) is formed in the main body 2 of the model railcar for cleaning positioned at a portion corresponding to the hole 45, a required solution may be injected from the outside into the solution container 43. The solution injected through the inlet 6 and the hole 45 flows onto the cleaning pad 51 attached to the cleaning pad attachment part 47 through the through hole 48. A closure (not illustrated) having a form such as a screw is preferably provided in the hole 45 to be opened only when the solution is injected. The through hole 48 has an appropriate diameter so that the solution slowly flows onto the cleaning pad 51.

Figure 7:
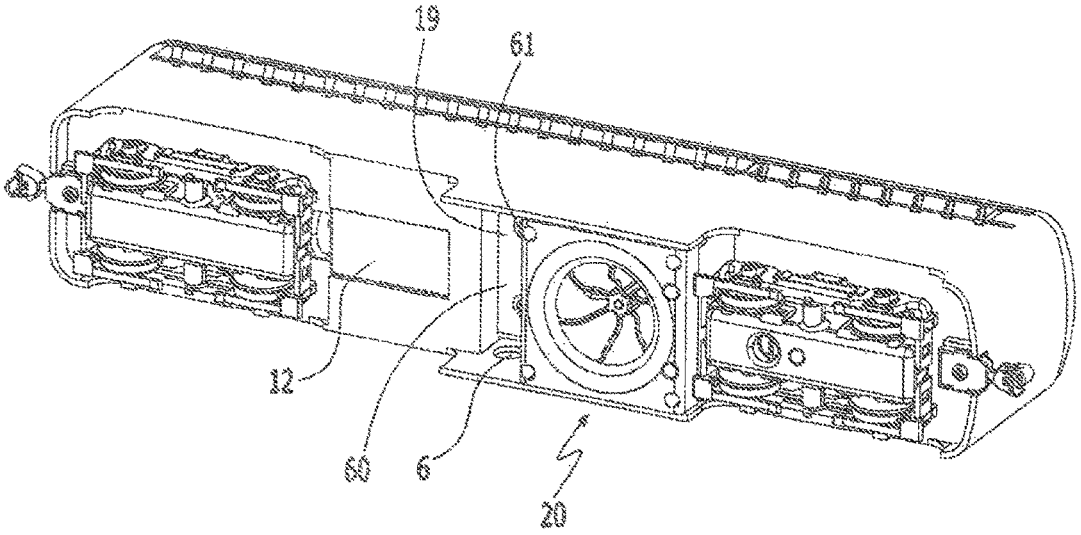
FIG. 7 is a bottom perspective view of a model train in a state in which a cleaning block is removed.

The cleaning block 41 is attached to a central portion 2' of the main body of the model railcar 1. In order to attach the cleaning block 41, a groove 19, which opens toward a lower portion of the model railcar 1 and into which a portion of the solution container 41 of the cleaning block is inserted, is formed in the central portion 2' of the main body. Referring to FIG. 4 and FIG. 7 which is a bottom perspective view of the model railcar 1 in a state in which the cleaning block 41 is removed, ferromagnetic metal, in the embodiment, an iron plate 60, fixed by screws 61 is positioned on an upper portion of the groove 19. Meanwhile, since a magnet 49 is positioned along a wall of the solution container 43 of the cleaning block, when the portion of the solution container 41 of the cleaning block is inserted into the groove 19, the magnet 49 and the iron plate 60 are magnetically combined, and thus the cleaning block 41 is easily detachably attached to the central portion 2' of the main body of the model railcar. Due to the attachment and detachment of the cleaning block 41, since the inside of the solution container 41 may be washed by separating the cleaning block 41 as necessary, the attachment and detachment of the cleaning block 41 is very convenient.

Figure 8:
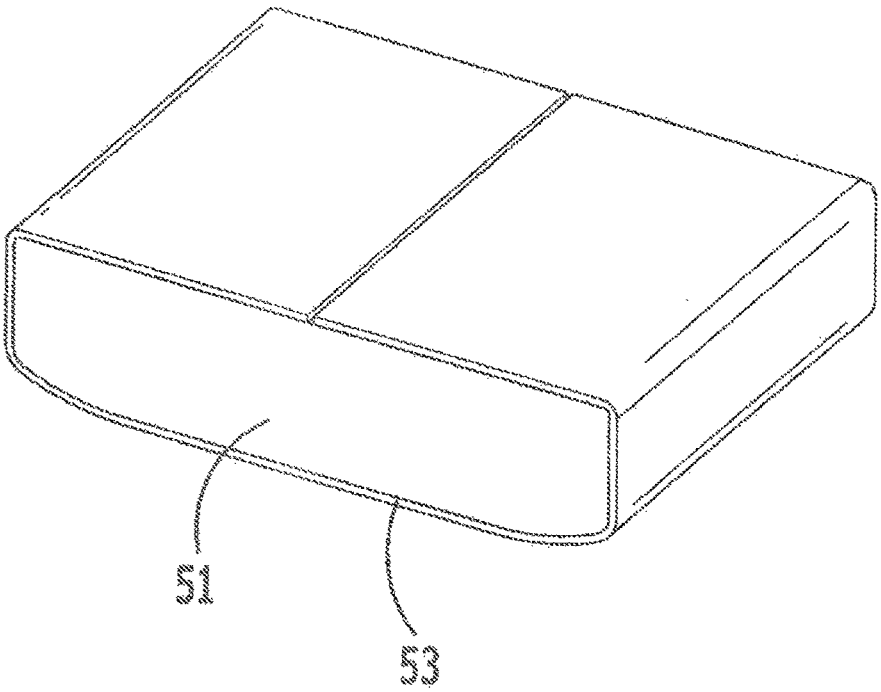
FIG. 8 is a perspective view of a cleaning pad.

The cleaning pad 51 is detachably attached to the cleaning block 41. Referring to FIGS. 4, 6, and 8, for the attachment and detachment, the cleaning pad attachment part 47 of the cleaning block is formed as a groove having a rectangular cross section, and the cleaning pad 51 has a plat block form which is pressed and inserted into the groove having the rectangular cross section. The cleaning pad 51 serves to clean the rails by coming into contact with the rails of the model train track. To this end, a member 53 capable of polishing or cleaning the rails is positioned on a surface of the cleaning pad 51, which faces the rails of the model train track, that is, a lower end surface thereof. A member capable of polishing the rails may refer to a member used for removing an oxide film from surfaces of the rails and sand paper made of a cloth may be used as, for example, the member. A member capable of cleaning the rails may refer to a member used for removing an oil film from the surfaces of the rails and a cloth for cleaning, a paper towel, and the like may be used as, for example, the member. In the embodiment, the member 53 capable of polishing or cleaning the rails surrounds an upper surface and lower surface the cleaning pad 51 of the plate block like a bag.

It is very important that the cleaning pad 51 used in the present invention is formed of an elastic material such as a sponge. This is because the cleaning pad 51 may be easily pressed and inserted into the cleaning pad attachment part 47 of the cleaning block as described in the embodiment, and the member 53 capable of polishing or cleaning the rails, which is attached to the lower end surface of the cleaning pad 51, may elastically press the rails in order to surely clean the rails. In order to ensure the elastic pressing on the rails, as illustrated in a partially enlarged view of FIG. 4, the lower end surface of the cleaning pad 51 is formed to be positioned lower than lowermost points of the train wheels 7 (i.e., upper surfaces of the rails of the model train track). When the lower end surface of the cleaning pad 51 is positioned relatively higher than the lowermost points of the train wheels 7, this results in excessive wear on the rails and will become an obstacle to smooth driving of the model train. When the lower end surface of the cleaning pad 51 is positioned relatively lower than the lowermost points of the train wheels 7, an elastic pressing force with respect to the rails may be reduced and the rails may be insufficiently cleaned. In order to reasonably adjust both cases, when a sponge for cleaning, which is made of a synthetic resin and can be conventionally obtained on the market, uses an elastic material, a distance t between the lower end surface of the cleaning pad 51 and the lowermost point of the train wheel 7 in the illustrated embodiment is set to be about 0.5 mm. Further, in the embodiment of the present invention, a body of the model railcar for cleaning 1, that is, the main body and the cover, are formed of zinc (Zn). When the body of the model railcar for cleaning 1 is formed of zinc in this manner, a weight of the model railcar for cleaning 1 having a reduction rate of 1:87 according to an "HO" gauge is set to be about 550 g, and the above-described elastic pressing force with respect to the rails may be more surely increased due to this weight.

As described above, when the solution is appropriately injected through the inlet 6 and the hole 45, the solution flows onto the upper surface of the cleaning pad 51 attached to the cleaning pad attachment part 47 through the through hole 48. In the embodiment, since the member 53 capable of polishing or cleaning the rails surrounds the upper surface and lower surface of the cleaning pad 51 like a bag, the solution on the upper surface of the cleaning pad 51 flows toward the lower surface of the cleaning pad 51 over the member 53, and wets the surfaces of the rails. When the cleaning pad 51 having sand paper made of a cloth is used in order to remove an oxide film from the surfaces of the rails, water or a polishing solution is preferably used, but no solution may also be used. Meanwhile, when the cleaning pad 51 having a cloth for cleaning is used in order to remove an oil film from the surfaces of the rails, alcohol, benzene, or a chromic acid mixture is preferably used as the solution. A single cleaning pad 51 may be used while the member 53 for polishing the rails or the member 53 for cleaning the rails is replaced, or the cleaning pad 51 having the member 53 for polishing the rails and the cleaning pad 51 having the member 53 for cleaning the rails may be separately used. When different solutions are used, the cleaning block may include a plurality of solution containers 43, and each of the solution containers 43 may only use a predetermined solution. In this case, a plurality of inlets 6 of the main body 2 of the model railcar for cleaning and a plurality of holes 45 of the cleaning block 41 have to be formed to correspond to the number of the solution containers 43.

Referring to FIG. 2, the model railcar for cleaning 1 according to the present invention includes permanent magnets 50 and 50' which are positioned to face the model train track in order to remove fine metal components such as metal powder which may cause a failure of speakers. A pair of the permanent magnets 50 are positioned at a side of a bottom surface of the fan structure 20 and are spaced to correspond to distances between the train wheels 7, and the permanent magnet 50' is positioned at a wheel moving body 9. The permanent magnet 50 is a magnet for removing fine metal components from the rails, and the permanent magnet 50' is a magnet for removing fine metal components from a portion of the train track between the rails.

INDUSTRIAL APPLICABILITY

In the model railcar for cleaning according to the present invention, a configuration thereof may be simple, an oxide film and an oil film may be removed from surfaces of rails while preventing the rails from being excessively worn, fine metal components such as metal powder and the like may also be simultaneously removed therefrom, and thus cleaning is very convenient.

The invention claimed is:

1. A model railcar for cleaning a model train track, which is a model railcar for cleaning a model train track while being driven along the model train track by a motor which is driven by electricity supplied through rails of the model train track and train wheels, the model railcar comprising:

a fan arranged toward the model train track;

a dust collecting chamber configured to accommodate foreign substances suctioned by the fan; and a cleaning block having a cleaning pad attached to a surface of the model train track, which faces the rails, wherein a cleaning member is removably attached to the cleaning pad and surrounds an upper surface and lower surface of the cleaning pad, wherein a first cleaning member is removably attached to the cleaning pad to polish the rails and a second cleaning member is removably attached to wash the rails, wherein:

the fan is driven by another motor and suctions the foreign substances on the model train track;

the suctioned foreign substances are moved to the dust collecting chamber through a path connected to the dust collecting chamber;

the cleaning block including a solution container positioned on an upper portion thereof and a cleaning pad attachment part positioned on a lower portion thereof, and is detachable from a lower portion of the model railcar;

a through hole is formed between the solution container and the cleaning pad attachment part so that a solution in the solution container is transferred to the cleaning pad;

the cleaning pad is detachable from the cleaning block and formed of an elastic material; and a lower end surface of the cleaning pad is positioned lower than upper surfaces of the rails of the model train track, is elastically pressed, and comes into contact with the rails.

2. The model railcar of claim 1, wherein the model railcar includes a main body and a cover, a magnet is attached to one surface of surfaces through which the main body and the cover come into contact with each other, and a ferromagnetic metal is attached to another surface thereof.

3. The model railcar of claim 2, wherein the main body and cover of the model railcar for cleaning are formed of zinc.

4. The model railcar of claim 1, wherein a magnet is attached to one surface of surfaces through which the cleaning block and the model railcar come into contact with each other, a ferromagnetic metal is attached to another surface thereof, and the cleaning block is detachable from the lower portion of the model railcar.

5. The model railcar of claim 1, wherein a groove is formed in the cleaning pad attachment part of the cleaning block, the cleaning pad is pressed and inserted into the groove, and the cleaning pad is detachable from the cleaning block.

6. The model railcar of claim 5, wherein the cleaning pad attachment part of the cleaning block is a groove having a rectangular cross section, and the cleaning pad is a plate block form having a rectangular cross section.

7. The model railcar of claim 1, wherein the cleaning block has a plurality of solution containers.

8. The model railcar of claim 1, wherein the model railcar for cleaning further includes a permanent magnet positioned to face the model train track.

9. The model railcar of claim 1, wherein an inlet through which the solution is injectable into the solution container is formed on a side surface of the model railcar.

* * * * *